US011273532B2

(12) United States Patent
Tanahashi et al.

(10) Patent No.: US 11,273,532 B2
(45) Date of Patent: Mar. 15, 2022

(54) VIBRATING BARREL POLISHING METHOD AND VIBRATING BARREL POLISHING SYSTEM

(71) Applicant: SINTOKOGIO, LTD., Nagoya (JP)

(72) Inventors: Shigeru Tanahashi, Aichi (JP); Naoyuki Ogiwara, Kitanagoya (JP)

(73) Assignee: SINTOKOGIO, LTD., Nagoya (JP)

( * ) Notice: Subject to any disclaimer, the term of this patent is extended or adjusted under 35 U.S.C. 154(b) by 785 days.

(21) Appl. No.: 16/088,935

(22) PCT Filed: Mar. 24, 2017

(86) PCT No.: PCT/JP2017/012110
§ 371 (c)(1),
(2) Date: Sep. 27, 2018

(87) PCT Pub. No.: WO2017/170257
PCT Pub. Date: Oct. 5, 2017

(65) Prior Publication Data

US 2019/0111539 A1 Apr. 18, 2019

(30) Foreign Application Priority Data

Mar. 28, 2016 (JP) ..... JP2016-063070

(51) Int. Cl.
*B24B 1/04* (2006.01)
*B24B 31/027* (2006.01)
(Continued)

(52) U.S. Cl.
CPC ..... *B24B 31/06* (2013.01); *B24B 1/04* (2013.01); *B24B 31/003* (2013.01);
(Continued)

(58) Field of Classification Search
CPC ..... B24B 1/04; B24B 31/003; B24B 31/02; B24B 31/0224; B24B 31/027;
(Continued)

(56) References Cited

U.S. PATENT DOCUMENTS 3,464,163 A * 9/1969 Ferrara ..... B24B 31/064 451/113
5,125,191 A * 6/1992 Rhoades ..... B24B 1/00 451/113
(Continued)

FOREIGN PATENT DOCUMENTS

CN 102085638 A 6/2011
CN 104889877 A 9/2015
(Continued)

OTHER PUBLICATIONS

International Preliminary Report on Patentability dated Oct. 11, 2018 for PCT/JP2017/012110.

*Primary Examiner* — Eileen P Morgan
(74) *Attorney, Agent, or Firm* — Faegre Drinker Biddle & Reath LLP

(57) ABSTRACT

In one embodiment, a vibration barrel polishing method using a vibration barrel polishing system that includes a polishing tank having a bottom surface therein and a polishing jig capable of holding a workpiece and rotatable around a rotation axis is provided. This method includes a step of supporting the polishing jig in the polishing tank in a state in which a lowermost portion of the polishing jig is separated from the bottom surface, a clearance d between the lowermost portion of the polishing jig and the bottom surface being greater than or equal to a grain diameter of a polishing medium, a step of causing the polishing medium to flow in the polishing tank, and a step of rotating the polishing jig around the rotation axis in the state in which the
(Continued)

Figure 1:
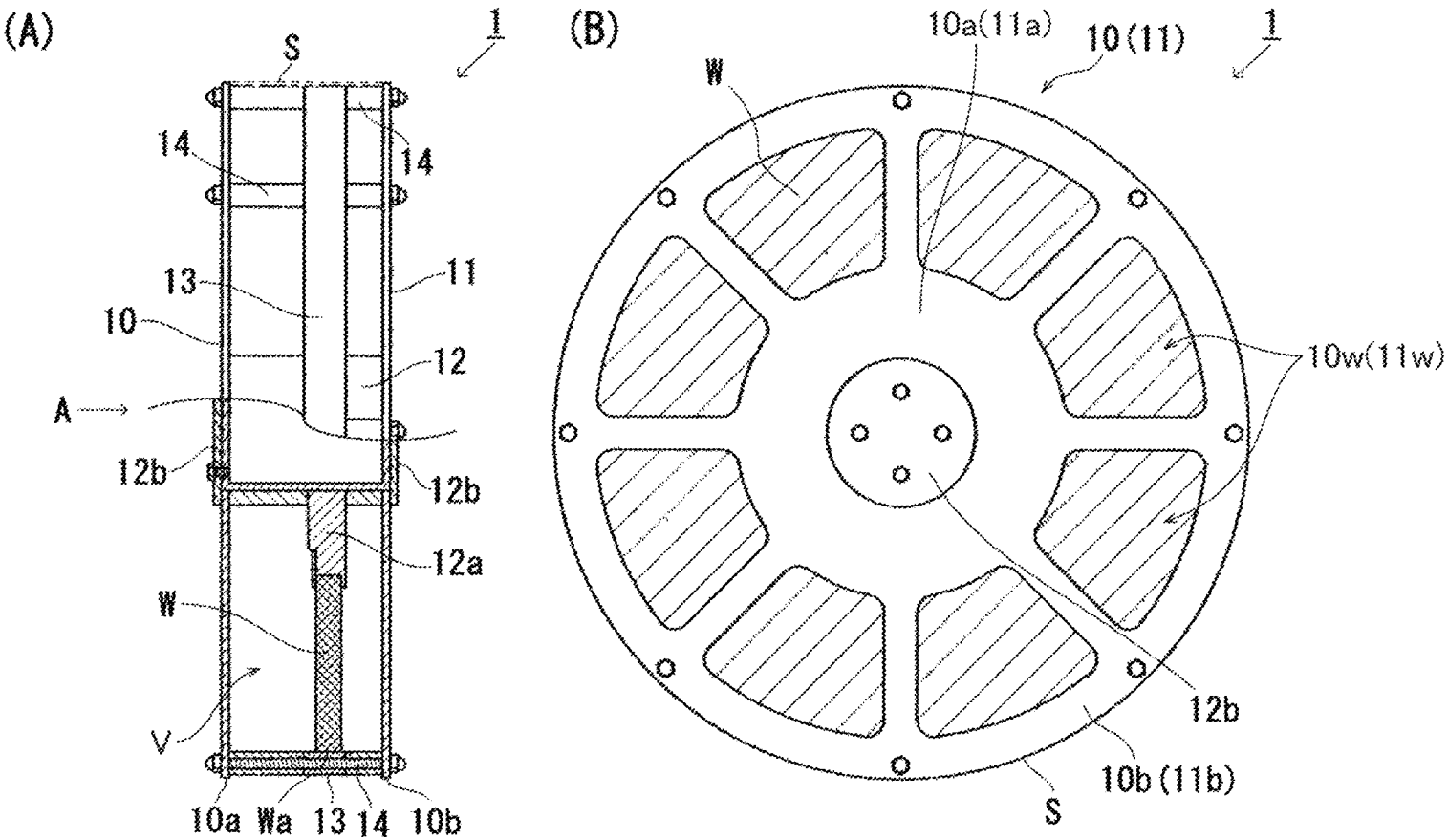

lowermost portion of the polishing jig is separated from the bottom surface.

12 Claims, 5 Drawing Sheets

(51) Int. Cl.

| | |
|---|---|
| ***B24B 31/06*** | (2006.01) |
| ***B24B 31/12*** | (2006.01) |
| ***B24B 31/067*** | (2006.01) |
| ***B24B 31/02*** | (2006.01) |
| ***B24B 31/00*** | (2006.01) |
| *B24B 49/00* | (2012.01) |
| *B24B 41/02* | (2006.01) |

(52) U.S. Cl.
CPC ..... *B24B 31/027* (2013.01); *B24B 31/0224* (2013.01); *B24B 31/064* (2013.01); *B24B 31/067* (2013.01); *B24B 31/12* (2013.01); *B24B 41/02* (2013.01); *B24B 49/00* (2013.01)

(58) Field of Classification Search
CPC ..... B24B 31/03; B24B 31/06; B24B 31/064; B24B 31/067; B24B 31/14
USPC ... 451/32, 35, 104, 106, 113, 326, 327, 328, 451/330
See application file for complete search history.

(56) References Cited

U.S. PATENT DOCUMENTS

| | | | | |
|---|---|---|---|---|
| 6,875,081 | B2 * | 4/2005 | Hoffman | B23D 61/021 451/32 |
| 7,871,307 | B2 * | 1/2011 | Watanabe | B24B 31/108 451/32 |
| 9,017,142 | B2 * | 4/2015 | van Kleef | B24B 31/003 451/36 |
| 9,862,068 | B2 * | 1/2018 | Ogiwara | B24B 31/073 |
| 10,722,996 | B2 * | 7/2020 | Bianchi | F04D 29/542 |
| 2011/0136410 | A1 * | 6/2011 | Inatani | B24B 31/064 451/36 |
| 2013/0323071 | A1 * | 12/2013 | Boon Beng | B24B 31/003 416/234 |

FOREIGN PATENT DOCUMENTS

| | | | |
|---|---|---|---|
| CN | 105263674 | A | 1/2016 |
| DE | 2344639 | A1 | 3/1975 |
| EP | 0073536 | A2 | 3/1983 |
| EP | 2329916 | A1 | 6/2011 |
| EP | 2857144 | A1 | 4/2015 |
| JP | S58-40262 | A | 3/1983 |
| JP | H04-269161 | A | 9/1992 |
| JP | H09-70748 | A | 3/1997 |
| JP | H09-234662 | A | 9/1997 |
| JP | 2000-280162 | A | 10/2000 |
| JP | 4148589 | B2 | 9/2008 |
| JP | 2011-115904 | A | 6/2011 |
| JP | 2015-27709 | A | 2/2015 |

* cited by examiner (A)

(B)

(B)

VIBRATING BARREL POLISHING METHOD AND VIBRATING BARREL POLISHING SYSTEM

TECHNICAL FIELD

The present invention relates to a vibration barrel polishing method and a vibration barrel polishing system.

BACKGROUND ART

There has been a known vibration barrel polishing apparatus for polishing a surface of a workpiece corresponding to a polished object to have a predetermined surface roughness, or removing a burr or an oxide film, etc.

For example, a vibration barrel polishing apparatus described in Patent Literature 1 includes a polishing tank and a drive unit that vibrates the polishing tank. When a workpiece is polished using this vibration barrel polishing apparatus, the workpiece and a polishing medium are charged into the polishing tank, and the polishing tank is vibrated along a substantially arc-shaped track. In this way, a polished object and the polishing medium relatively move, and the workpiece is polished. In addition, in this vibration barrel polishing apparatus, collision between a plurality of workpieces having a flat shape, for example, a disk shape is prevented by polishing the plurality of workpieces in a state in which the plurality of workpieces is disposed at predetermined intervals along a direction perpendicular to a flow direction.

Patent Literature 2 describes a chamfering apparatus including a cylindrical vibrating tank, a vibrator for rotating and vibrating the vibrating tank, a vibration barrel device for supporting the vibrating tank, a lifting and lowering device for lifting and lowering a disc-shaped workpiece, and a workpiece rotating device for rotating the workpiece. This Patent Literature describes that deburring and chamfering of the workpiece are performed at the same time by holding the workpiece inside the polishing tank, and rotating the workpiece in an opposite direction to a polishing material circulating in the polishing tank.

Patent Literature 3 describes a polishing jig for vibration barrel polishing including a first guard member, a second guard member, and a fixed member. The first guard member and the second guard member have a disc shape having a larger diameter than that of a workpiece, and are disposed to face each other. The fixed member is provided between the first guard member and the second guard member, and fixes the workpiece to the polishing jig. In this Patent Literature, the workpiece is polished while the workpiece is prevented from colliding with a bottom surface of the polishing tank by rolling the polishing jig to which the workpiece is fixed on the bottom surface of the polishing tank in a self-standing state.

CITATION LIST

Patent Literature

Patent Literature 1: Japanese Unexamined Patent Publication No. 2000-280162

Patent Literature 2: Japanese Unexamined Patent Publication No. H9-070748

Patent Literature 3: Japanese Unexamined Patent Publication No. 2015-27709

SUMMARY OF INVENTION

Technical Problem

In the apparatus described in Patent Literature 3, since the polishing jig is rolled on the bottom surface of the polishing tank in the self-standing state, a polishing medium may be crushed between the polishing tank and the polishing jig. When the polishing medium is crushed, there is a concern that a peripheral portion of the workpiece, etc. may be damaged, or a polishing defect may occur.

Therefore, in this technical field, there is a demand for a vibration barrel polishing method and a vibration barrel system capable of inhibiting the polishing medium from being crushed between the polishing jig and the polishing tank.

Solution to Problem

In one aspect, a vibration barrel polishing method using a vibration barrel polishing system that includes a polishing tank having a bottom surface therein and a polishing jig capable of holding a workpiece and rotatable around a rotation axis is provided. This method comprises steps of: supporting the polishing jig in the polishing tank in a state in which a lowermost portion of the polishing jig is separated from the bottom surface, a clearance d between the lowermost portion of the polishing jig and the bottom surface being greater than or equal to a grain diameter of a polishing medium, causing the polishing medium to flow in the polishing tank, and rotating the polishing jig around the rotation axis in the state in which the lowermost portion of the polishing jig is separated from the bottom surface.

According to the vibration barrel polishing method of the aspect, since the polishing jig rotates at a position at which the lowermost portion of the polishing jig is separated from the bottom surface by a grain diameter of the poling medium or more, the polishing medium is inhibited from being ground between the polishing jig and the bottom surface of the polishing tank. In this way, the ground polishing medium may be inhibited from entering a gap between the polishing jig and the workpiece, and thus it is possible to inhibit the workpiece from being damaged or a polishing defect from occurring. In addition, according to this barrel polishing method, efficient polishing may be performed since a relative speed between the workpiece and the polishing medium may be increased by rotating the polishing jig.

In one embodiment, the clearance d may be $(H1+H2)/4$ or less, wherein H1 represents a maximum height of a surface of the polishing medium flowing in the polishing tank with respect to the bottom surface and H2 represents a minimum height thereof in a cross-sectional view along a plane orthogonal to the rotation axis and passing through a center of the bottom surface.

According to the above embodiment, polishing efficiency of the workpiece may be improved since the workpiece is disposed in a region in which a polishing force by the polishing medium is large by setting the clearance between the lowermost portion of the polishing jig and the bottom surface to $(H1+H2)/4$ or less.

In one embodiment, the workpiece may have a flat shape.

In a conventional vibration barrel polishing method, in the case of polishing a flat-shaped workpiece, for example, a disc-shaped workpiece, sufficient polishing may not be carried out since the workpiece complicatedly moves in the polishing tank during polishing using the polishing medium. On the other hand, according to the vibration barrel polishing method of the above embodiment, since the workpiece is polished in a state in which the polishing jig is supported, polishing may be performed while maintaining a posture at the time of charging the workpiece. The flat-shaped workpiece refers to a workpiece having a larger contour shape than a thickness such as a plate shape, a ring shape, a frame shape, a cylindrical shape having a larger diameter than a height, etc.

In one embodiment, the polishing jig may include a first guard member and a second guard member disposed to face each other through an accommodation space, a contour shape of the first guard member and the second guard member having a disc shape larger than the workpiece, and a fixing member configured to fix the workpiece in the accommodation space such that the entire workpiece is located inside the accommodation space, a window portion communicating with the accommodation space may be formed in each of the first guard member and the second guard member, and the polishing medium may be allowed to pass between an inside and an outside of the accommodation space through the window portion and an opening between an outer edge of the first guard member and an outer edge of the second guard member.

According to the polishing jig having the above configuration, polishing efficiency of the workpiece may be improved since the workpiece may be fixed in the polishing jig not to protrude from an outer edge of the polishing jig, and the polishing medium may be easily caused to flow in the polishing jig.

In one embodiment, the polishing medium may be caused to flow to draw an arc-shaped trajectory inside the polishing tank in the step of causing the polishing medium to flow in the polishing tank, and the polishing jig may be rotated in the same direction as a flow direction of the polishing medium in the step of rotating the polishing jig around the rotation axis.

In the barrel polishing method according to the above embodiment, uniformity of polishing of the workpiece may be improved by rotating the polishing jig in the same direction as the flow direction of the polishing medium.

In one embodiment, the polishing medium may be caused to flow to draw an arc-shaped trajectory inside the polishing tank in the step of causing the polishing medium to flow in the polishing tank, and the step of rotating the polishing jig around the rotation axis may include a step of rotating the polishing jig in the same direction as a flow direction of the polishing medium and a step of rotating the polishing jig in an opposite direction of the flow direction of the polishing medium.

In the above embodiment, it is possible to improve uniformity of polishing and improve a polishing rate by switching a rotation direction of the polishing jig to perform polishing.

A vibration barrel polishing system of one aspect includes a polishing tank, a polishing jig that holds a workpiece, a positioning unit that supports the polishing jig in the polishing tank, the positioning unit being capable of changing a position of the polishing jig in a height direction, and a rotating unit that rotates the polishing jig around a rotation axis.

According to the vibration barrel polishing system of the above aspect, since the polishing jig may be supported at a height at which the polishing medium is not ground between the polishing jig and the bottom surface of the polishing tank using the positioning unit, it is possible to inhibit the ground polishing medium from entering a gap between the polishing jig and the workpiece. Therefore, it is possible to inhibit the workpiece from being damaged, and a polishing defect from occurring. In addition, a relative speed with respect to the polishing medium may be increased by performing vibration barrel polishing of the workpiece while rotating the polishing jig around the rotation axis using the rotating unit. As a result, efficient polishing may be performed.

In one embodiment, the vibration barrel polishing system further includes a moving unit that moves the polishing jig along a horizontal direction, and the positioning unit, the rotating unit, and the moving unit may be integrally provided.

Since the vibration barrel polishing system of the above embodiment includes the moving unit that moves the polishing jig along the horizontal direction, the polishing jig may be easily charge into the polishing tank. In addition, since the positioning unit, the rotating unit, and the moving unit are integrally formed in this vibration barrel polishing system, a working space for setting the polishing jig and the vibration barrel polishing apparatus may be efficiently disposed. In this way, a space for the vibration barrel polishing system may be reduced.

Advantageous Effects of Invention

According to an aspect and various embodiments of the invention, it is possible to inhibit a polishing medium from being crushed between a polishing jig and a polishing tank.

BRIEF DESCRIPTION OF DRAWINGS (A) of FIG. 1 is a side view of a polishing jig holding a workpiece in a partially cut state, and (B) of FIG. 1 is a diagram of the polishing jig illustrated in (A) of FIG. 1 viewed from a direction of an arrow A of (A) of FIG. 1.

Figure 2:
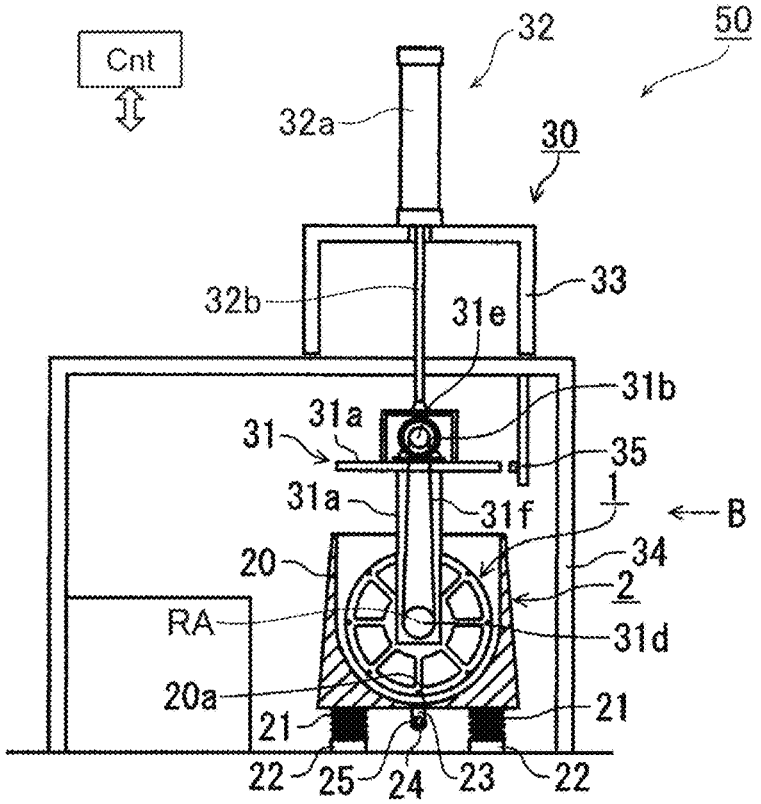
Figure 2:
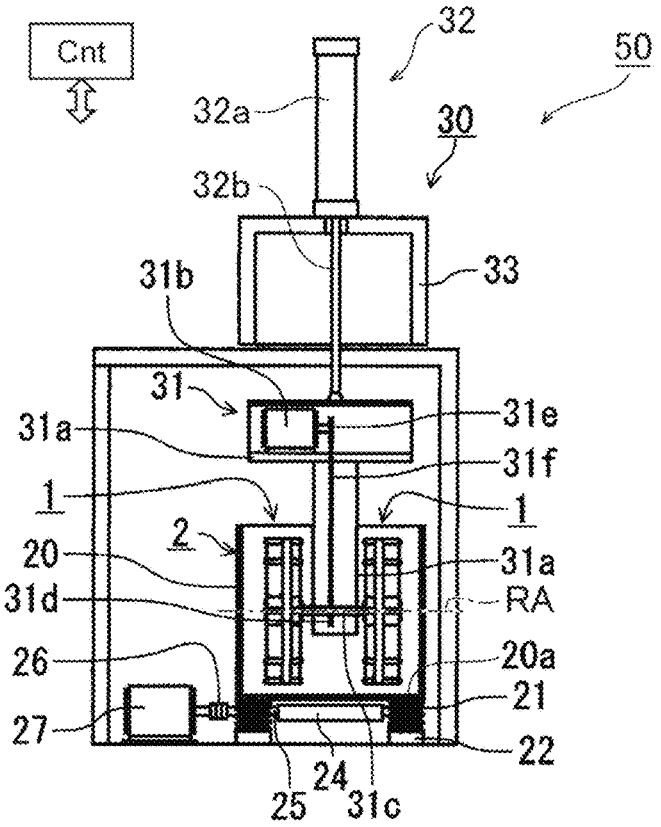

(A) of FIG. 2 is a side view of a vibration barrel polishing system in a partially cut state, and (B) of FIG. 2 is a diagram of the vibration barrel polishing system illustrated in (A) of FIG. 2 viewed from a direction of an arrow B of (A) of FIG. 2.

Figure 3:
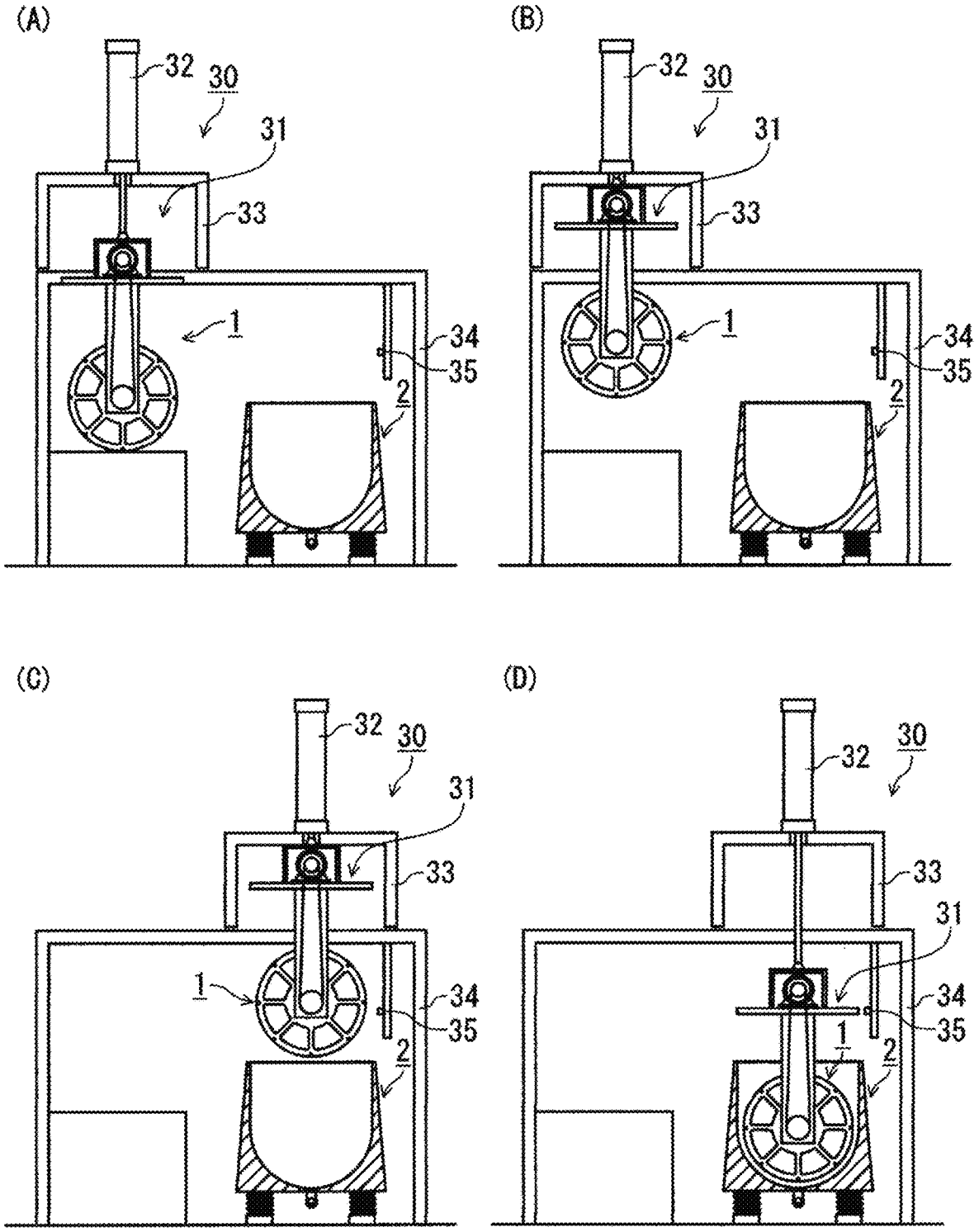

FIG. 3 is a diagram for a description of a step of supporting the polishing jig in a polishing tank.

Figure 4:
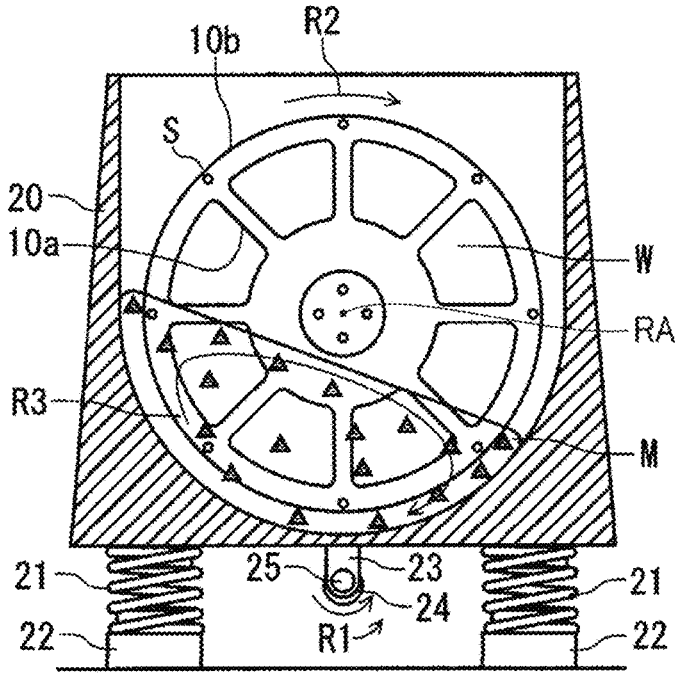
Figure 4:
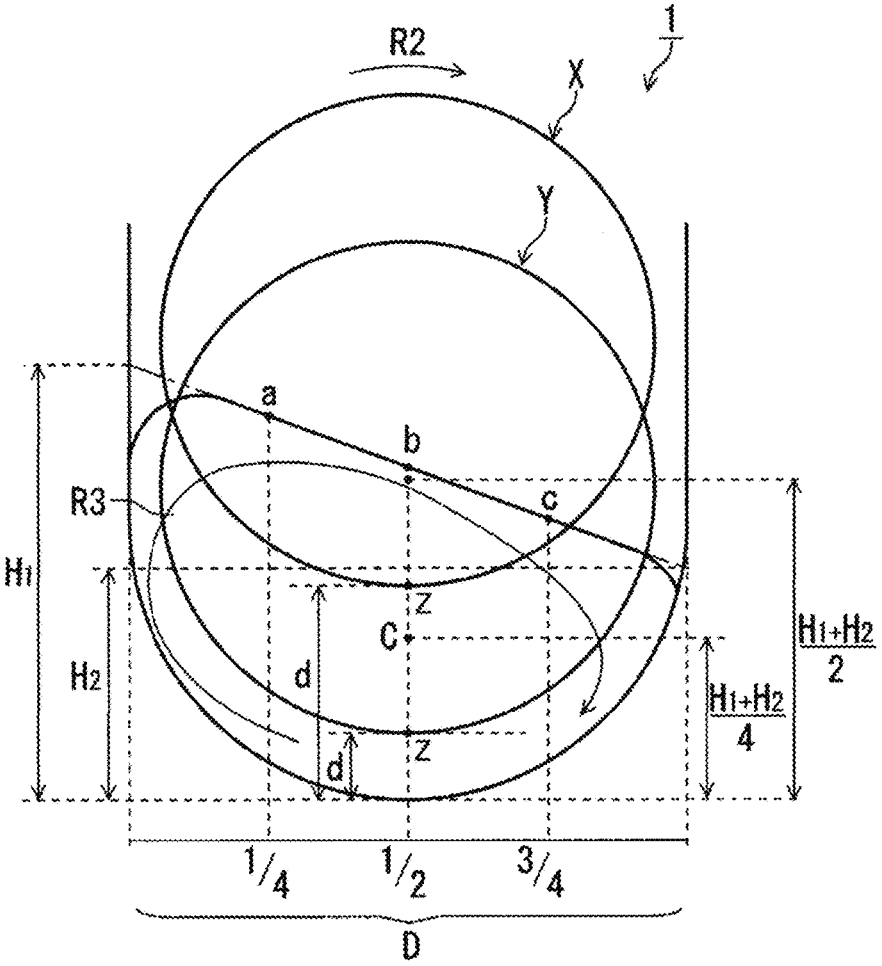

(A) of FIG. 4 is a cross-sectional view schematically illustrating a flow state of a polishing medium, and (B) of FIG. 4 is a diagram schematically illustrating a positional relationship between the polishing medium and the polishing jig.

Figure 5:
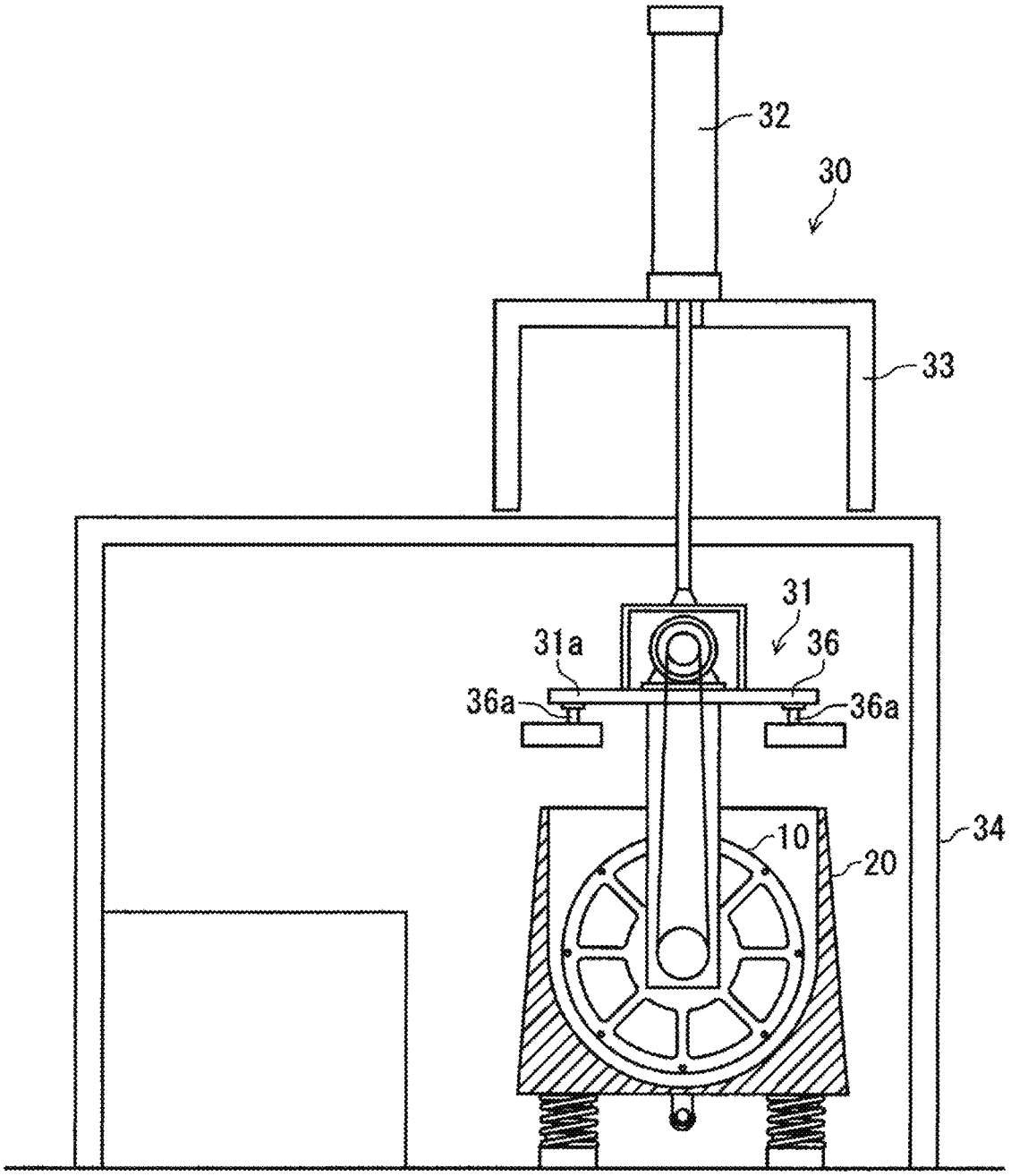

FIG. 5 is a schematic view illustrating a modified example of a positioning unit.

DESCRIPTION OF EMBODIMENTS

A description will be given of a vibration barrel polishing method of an embodiment with reference to drawings. Hereinafter, a description will be given of an embodiment in which a portion around an outer periphery of a disc-shaped workpiece W corresponding to a polished object is polished.

FIG. 1 is a diagram illustrating a polishing jig used for a vibration barrel polishing method of an embodiment. (A) of FIG. 1 is a side view of the polishing jig 1 in a partially cut state, and (B) of FIG. 1 is a diagram of the polishing jig 1 viewed from a direction of an arrow A of (A) of FIG. 1. The polishing jig 1 is a jig for holding the workpiece W, and has a flat and substantially cylindrical outer shape. The polishing jig 1 includes a first guard member 10, a second guard member 11, and a fixing member 12.

The first guard member 10 is a disc-shaped member having a diameter larger than an outer diameter of the workpiece W, and includes a central portion 10*a*, a peripheral portion 10*b*, and a connecting portion 10*c*. The central portion 10*a*, the peripheral portion 10*b*, and the connecting portion 10*c* are integrally formed. The central portion 10*a* has a circular planar shape. The peripheral portion 10*b* has an annular planar shape and is disposed to surround the central portion 10*a*. An outer diameter of the central portion 10*a* is smaller than an inner diameter of the peripheral portion 10*b*. The connecting portion 10*c* radially extends from a center of the central portion 10*a* in a radial direction and connects the central portion 10*a* and the peripheral portion 10*b* to each other.

A space surrounded by the central portion 10*a*, the peripheral portion 10*b*, and the connecting portion 10*c* is a window portion 10*w* penetrating the first guard member 10 in a plate thickness direction. In the present embodiment, eight connecting portions 10*c* are positioned at approximately equal intervals in a circumferential direction of the first guard member 10. For this reason, eight window portions 10*w* are formed in the first guard member 10. The window portion 10*w* is formed at a position corresponding to a polishing target region of the workpiece W held by the polishing jig 1. In (B) of FIG. 1, a region of the workpiece W exposed from the window portion 10*w* is indicated by oblique lines.

The second guard member 11 is a disc-shaped member having a diameter larger than a diameter of the workpiece W. The second guard member 11 has substantially the same shape as that of the first guard member 10. The second guard member 11 includes a central portion 11*a*, a peripheral portion 11*b*, and a connecting portion 11*c*. The central portion 11*a*, the peripheral portion 11*b*, and the connecting portion 11*c* are integrally formed. The central portion 11*a* has a circular planar shape. The peripheral portion 11*b* has an annular planar shape and is disposed to surround the central portion 11*a*. An outer diameter of the central portion 11*a* is smaller than an inner diameter of the peripheral portion 11*b*. The connecting portion 11*c* radially extends from a center of the central portion 11*a* in a radial direction and connects the central portion 11*a* and the peripheral portion 11*b* to each other.

A space surrounded by the central portion 11*a*, the peripheral portion 11*b*, and the connecting portion 11*c* is a window portion 11*w* penetrating the second guard member 11 in the plate thickness direction. In the present embodiment, eight connecting portions 11*c* are positioned at approximately equal intervals in a circumferential direction of the second guard member 11. For this reason, eight window portions 11*w* are formed in the second guard member 11. The window portion 11*w* is formed at a position corresponding to the polishing target region of the workpiece W held by the polishing jig 1.

The first guard member 10 and the second guard member 11 are disposed to face each other. A substantially cylindrical accommodation space V is defined between the first guard member 10 and the second guard member 11. An annular virtual curved surface S extends between an outer peripheral edge of the first guard member 10 and an outer peripheral edge of the second guard member 11 to connect the outer peripheral edges. In other words, the accommodation space V is a space surrounded by the first guard member 10, the second guard member 11 and the virtual curved surface S, and is an internal space of the polishing jig 1. The polishing jig 1 has a flat cylindrical shape and may self-stand in a state in which the outer peripheral edges of the first guard member 10 and the second guard member 11 are in contact with a floor surface, etc. (a state in which the virtual curved surface S faces the floor surface, etc.).

The fixing member 12 includes a holding portion 12*a* and an attachment plate 12*b*. The holding portion 12*a* is disposed between the first guard member 10 and the second guard member 11, that is, in the accommodation space V. The holding portion 12*a* supports an inner peripheral edge of the workpiece W while being inserted into a through-hole formed at a center portion of the workpiece W. In this way, the workpiece W is attached to the holding portion 12*a*. The attachment plate 12*b* is disposed on outer surfaces of the central portions 10*a* and 11*a*, respectively. When the holding portions 12*a* and the attachment plate 12*b* are fastened by fastening members such as bolts while the holding portions 12*a* and the attachment plate 12*b* interpose the central portions 10*a* and 11*a* therebetween, the workpiece W is fixed to the first guard member 10 and the second guard member 11. As a result, the workpiece W is fixed in the accommodation space V such that the entire workpiece W is located in the accommodation space V. In a state in which the workpiece W is attached to the holding portion 12*a*, a pair of main surfaces of the workpiece W faces inner surfaces of the first guard member 10 and the second guard member 11, respectively.

Since the first guard member 10 and the second guard member 11 have an outer shape larger than the workpiece W, the entire workpiece W is accommodated in the accommodation space V without protruding from the accommodation space V. In one embodiment, the workpiece W may be attached to the fixing member 12 such that a center of gravity of the workpiece W substantially matches (completely matches or is close to) a center of gravity of the polishing jig 1. In this way, the polishing jig 1 holding the workpiece W easily rotates around a rotation axis RA described below.

In one embodiment, the polishing jig 1 may further include a masking member 13 and an attachment member 14. The masking member 13 has an annular shape and extends to surround an outer peripheral surface Wa of the workpiece W from the outside. The masking member 13 is attached between the first guard member 10 and the second guard member 11 while being interposed by the attachment member 14 from both sides in a facing direction of the first guard member 10 and the second guard member 11. For this reason, the masking member 13 is connected to the peripheral portion 10*b* and the peripheral portion 11*b* via the attachment member 14. Since the outer peripheral surface Wa of the workpiece W is covered with the masking member 13, contact with a polishing medium M is prevented.

Therefore, in the present embodiment, the outer peripheral surface Wa of the workpiece W corresponds to a non-polished region in which polishing by the polishing medium M is not performed. A width of the masking member 13 may be larger than a thickness of the workpiece W.

A description will be given on a vibration barrel polishing system of an embodiment used for the vibration barrel polishing method. (A) of FIG. 2 is a side view of a vibration barrel polishing system 50 of the embodiment in a partially cut state, and (B) of FIG. 2 is a diagram of the vibration barrel polishing system 50 viewed from a direction of an arrow B of (A) of FIG. 2. The vibration barrel polishing system 50 illustrated in (A) of FIG. 2 and (B) of FIG. 2 includes the polishing jig 1, a vibration barrel polishing apparatus 2, and a support apparatus 30. In the embodiment illustrated in (A) of FIG. 2 and (B) of FIG. 2, the vibration barrel polishing system 50 includes two polishing jigs 1. However, the vibration barrel polishing system 50 may include at least one polishing jig 1.

As illustrated in (A) of FIG. 2 and (B) of FIG. 2, the vibration barrel polishing apparatus 2 includes a polishing tank 20 having an open top. In FIG. 2A, the polishing jig 1 disposed in front is omitted such that an internal structure is easily viewed.

The polishing tank 20 has a bottom surface 20*a* on an inside thereof. As illustrated in (A) of FIG. 2, the bottom surface 20*a* has a substantially U shape in a cross-sectional view taken along a plane orthogonal to the rotation axis RA of the polishing jig 1. The polishing tank 20 is installed on a pedestal 22 through a spring 21. A bearing 23 and a rotating shaft 25 are provided below the polishing tank 20. The bearing 23 rotatably supports the rotating shaft 25. A counterweight 24 is fixed to the rotary shaft 25. Further, the rotating shaft 25 is connected to a motor 27 through a coupler 26 that transmits rotation.

The support apparatus 30 includes a rotating unit 31 and a positioning unit 32. The rotating unit 31 is a device for rotating the polishing jig 1 around the rotation axis RA, and includes a frame 31*a*, a motor 31*b*, a rotating shaft 31*c*, a sprocket 31*d*, a sprocket 31*e*, and a chain 31*f*. The frame 31*a* has a substantially T shape in a side view. The motor 31*b* corresponds to a power source for rotating the polishing jig 1, and is supported on the frame 31*a*. The rotating shaft 31*c* is an elongated member that extends in a direction matching the rotation axis RA of the two polishing jigs 1 and is inserted through a through-hole formed in the frame 31*a*. Both ends of the rotating shaft 31*c* are connected to centers of the first guard members 10 or the second guard members 11 of the two polishing jigs 1, respectively. The sprocket 31*d* is connected to the rotating shaft 31*c*. The sprocket 31*e* is connected to an output shaft of the motor 31*b*. The chain 31*f* is bridged between the sprocket 31*d* and the sprocket 31*e* to transmit a driving force generated in the motor 31*b* to the rotating shaft 31*c*. For this reason, the rotating shaft 31*c* is rotated by the driving force of the motor 31*b*. As a result, the polishing jig 1 rotates around the rotation axis RA. The rotation axis RA of the polishing jig 1 extends in a direction parallel to the rotating shaft 25 of the polishing tank 20.

The positioning portion 32 is a device that supports the polishing jig 1 in the polishing tank 20 such that a position of the polishing jig 1 in a height direction may be changed. The positioning section 32 includes, for example, a drive unit 32*a* and a chain 32*b*. The chain 32*b* connects the drive unit 32*a* and the frame 31*a* to each other. The drive unit 32*a* transmits a driving force for vertically moving the frame 31*a* to the frame 31*a* through the chain 32*b*. As illustrated in FIG. 2A, the positioning unit 32 of the embodiment may include a proximity switch 35. The proximity switch 35 is a sensor for detecting a descending end of the rotating unit 31. Upon detecting that the frame 31*a* has reached a preset descending end, the proximity switch 35 sends out a control signal to a controller Cnt described below such that a position of the frame 31*a* in the height direction is not lowered any further. In one embodiment, for example, the positioning unit 32 may have a mechanism that can control the amount of descent of the rotating unit 31 such as a servo cylinder instead of the proximity switch 35. In addition, an arbitrary sensor may be used regardless of whether the sensor corresponds to a contact type or a non-contact type as long as a lowermost position of the polishing jig 1 can be detected. In addition, the positioning unit 32 may have a configuration in which a framework capable of holding the frame 31*a* such that a height thereof can be varied is provided instead of a conveying apparatus that can move the frame 31*a* along a vertical direction.

In one embodiment, the support apparatus 30 may further include a moving unit 33. For example, the moving unit 33 includes a driving mechanism using an electric motor, and may move the rotating unit 31 and the positioning unit 32 in a horizontal direction along a guide such as a rail provided on the frame 34. In this manner, the moving unit 33 moves the polishing jig 1 along with the rotating unit 31 and the positioning unit 32 in the horizontal direction by moving the rotating unit 31 and the positioning unit 32 in the horizontal direction.

The rotating unit 31, the positioning unit 32, and the moving unit 33 may be integrally formed. Here, a statement "the rotating unit 31, the positioning unit 32, and the moving unit 33 are integrally formed" means that the rotating unit 31, the positioning unit 32, and the moving unit 33 may function as an integrated device by being connected to one another. When the rotating unit 31, the positioning unit 32, and the moving unit 33 are integrally formed, a working space for setting the polishing jig 1 and the vibration barrel polishing apparatus 2 may be efficiently disposed, and thus a space for the vibration barrel polishing system 50 may be reduced.

In one embodiment, the vibration barrel polishing system 50 may further include the controller Cnt. The controller Cnt is a computer including a processor, a storage unit, etc., and controls each unit of the vibration barrel polishing system 50. For example, the controller Cnt sends a control signal to the motor 27 to control a rotation speed of the rotating shaft 25. Further, the controller Cnt sends control signals to the rotating unit 31, the positioning unit 32, and the moving unit 33 to control a rotation speed of the polishing jig 1 and positions of the polishing jig in the height direction and the horizontal direction.

Hereinafter, a description will be given of a barrel polishing method of one embodiment with reference to FIG. 3 and FIG. 4. (A) of FIG. 3 to (D) of FIG. 3 are diagrams for a description of a positional relationship between the polishing jig 1 and the polishing tank 20. (A) of FIG. 4 is a cross-sectional view taken along a plane orthogonal to the rotation axis RA and passing through a center of the bottom surface 20*a*, and illustrates a flow state of the polishing medium M in the polishing tank 20. In (A) of FIG. 4, for convenience of a description, the polishing medium M is illustrated in a larger dimension than an actual one. (B) of FIG. 4 is a diagram for a description of a positional relationship between the bottom surface 20*a* of the polishing tank 20 and the polishing jig 1.

In the vibration barrel polishing method of the embodiment, first, the two polishing jigs 1 that hold the workpiece W are prepared. The two polishing jigs 1 are connected to each other by the rotating shaft 31*c* connected thereto. In one embodiment, the rotating shaft 31*c* may be connected to the polishing jigs 1 by welding the both ends of the rotating shaft 31*c* to centers of facing surfaces of a pair of plates facing each other, and fastening the pair of plates to centers of the first guard members 10 and the second guard members 11 of the two polishing jigs 1, respectively, using bolts. When the rotating shaft 31*c* is connected to the polishing jig 1 as described above, the rotating shaft 31*c* is fastened to the center of gravity of the polishing jig 1. As illustrated in FIG. 3A, the polishing jig 1 to which the rotating shaft 31*c* is connected is held while being suspended by the rotating unit 31. In one embodiment, the workpiece W may be polished using only one polishing jig 1 instead of the two polishing jigs 1.

Subsequently, as illustrated in (B) of FIG. 3, the polishing jig 1 is moved upward by the positioning unit 32. Subsequently, as illustrated in (C) of FIG. 3, the polishing jig 1 is moved in the horizontal direction by the moving unit 33 such that the polishing jig 1 is located above the polishing tank 20.

Subsequently, as illustrated in (D) of FIG. 3, the positioning unit 32 lowers the polishing jig 1 such that the polishing jig 1 is positioned in the polishing tank 20. In this instance, the positioning portion 32 suspends descending of the polishing jig 1 before a lowermost portion Z of the polishing jig 1 comes into contact with the bottom surface 20*a*, and supports the polishing jig 1 in a state in which the lowermost portion Z of the polishing jig 1 is separated from the bottom surface 20*a*. In this support position, a clearance d between the lowermost portion Z of the polishing jig 1 and the bottom surface 20*a* of the polishing tank 20 is greater than or equal to a grain diameter of the polishing medium M.

Subsequently, in the vibration barrel polishing method of the embodiment, a predetermined amount of polishing medium M is charge into the polishing tank 20. Thereafter, the motor 27 of the vibration barrel polishing apparatus 2 is driven. When the motor 27 is driven, the counterweight 24 rotates around the rotating shaft 25, and the polishing tank 20 vibrates to draw a substantially arc-shaped trajectory according to the rotation of the counterweight 24.

For example, as illustrated in (A) of FIG. 4, when the rotating shaft 25 rotates in a direction R1, the polishing medium M flows in the polishing tank 20 to draw an arc-shaped trajectory R3 corresponding to a substantially arc shape in a plane orthogonal to the rotating shaft 25. As illustrated in (A) of FIG. 4, in a sectional view taken along the plane orthogonal to the rotation axis RA and passing through the center of the bottom surface 20*a*, a surface of the polishing medium M has a substantially straight line shape. Here, the surface of the polishing medium M refers to a liquid surface or a powder surface of the polishing medium M. In (B) of FIG. 4, in the sectional view illustrated in (A) of FIG. 4, a maximum height of the surface of the polishing medium M with respect to the bottom surface 20*a* is denoted by H1, and a minimum height thereof is denoted by H2. In addition, in (B) of FIG. 4, a maximum width of an internal space of the polishing tank 20 along the width direction is denoted by D, and heights of the surface of the polishing medium M at positions of D/4, D/2, and 3D/4 of the internal space in the width direction are denoted by a, b, and c. As illustrated in (A) of FIG. 4, the maximum height H1 and the minimum height H2 approximate to height positions of intersection points between a straight line on an XZ plane connecting the height positions a, b, and c and an internal wall surface of the polishing tank 20.

Subsequently, in the vibration barrel polishing method of the embodiment, the polishing jig 1 rotates around the rotation axis RA in the polishing tank 20 in a state in which the lowermost portion Z of the polishing jig 1 and the bottom surface 20*a* are separated by the clearance d. In this instance, the polishing jig 1 rotates in a direction R2 which is an opposite direction of the direction R1 in which the rotating shaft 25 rotates. This direction R2 is the same direction as the substantially arc-shaped trajectory R3 in which the polishing medium flows (that is, a vibration direction of the polishing tank 20 by the motor 27). The direction R2 is the same direction as a direction corresponding to a case in which the workpiece W is rolled without using the polishing jig 1.

When the polishing jig 1 rotates around the rotation axis RA in the polishing tank 20, the polishing medium M flowing inside the polishing tank 20 from an opening of the virtual curved surface S of the polishing jig 1 flows into the polishing jig 1. After the polishing medium M flowing into the polishing jig 1 polishes a polished region of the workpiece W, the polishing medium M is discharged to the outside of the polishing jig 1 from the window portion 10*w* and the window portion 11*w* communicating with the accommodation space V. When the polishing medium M flows inside the polishing jig 1, the polished region of the workpiece W is polished.

In the vibration barrel polishing method of the embodiment, since a relative speed between the workpiece W and the polishing medium M may be increased by rotating the polishing jig 1 inside the polishing tank 20, the workpiece W may be efficiently polished. In addition, it is possible to improve uniformity of polishing of the workpiece W attached to the polishing jig 1 when the polishing jig 1 rotates around the center of gravity thereof. Since the workpiece W is fixed inside the polishing jig 1 so as not to protrude from an outer edge of the polishing jig 1, the workpiece W is prevented from colliding with the polishing tank 20. Therefore, the workpiece W is prevented from being deformed, and a surface thereof is prevented from being scratched.

In addition, since the outer peripheral surface Wa of the workpiece W is covered with the masking member 13, a collision between the outer peripheral surface Wa and the polishing medium M is suppressed. Therefore, polishing of the outer peripheral surface Wa corresponding to the non-polished region is suppressed, and damage such as sagging or a dent is inhibited from occurring on the outer peripheral surface Wa.

In the vibration barrel polishing method of the embodiment, since the polishing jig 1 is supported in a state in which the lowermost portion Z of the polishing jig 1 and the bottom surface 20*a* of the polishing tank 20 are separated from each other by the grain diameter of the polishing medium M or more, the polishing medium M is inhibited from being crushed between the polishing jig 1 and the bottom surface 20*a* when the polishing jig 1 rotates. In this way, the crushed polishing medium M is inhibited from entering a gap between the polishing jig 1 and the workpiece W, and thus it is possible to inhibit the workpiece W from being damaged or a polishing defect from occurring due to the crushed polishing medium M.

Meanwhile, when the polishing jig 1 is held at an excessively high position, for example, as illustrated at a position X of (B) of FIG. 4, collision between the workpiece W and the polishing medium M is suppressed. When the collision between the workpiece W and the polishing medium M is suppressed, a polishing force for the workpiece W decreases, and unevenness easily occurs in a polished state of the workpiece W. Thus, a polishing time needs to be increased.

In the sectional view illustrated in (A) of FIG. 4, the polishing medium M circulates and flows to rotate inside the polishing tank 20 along the substantially arc-shaped trajectory R3. Here, when a position of a flow center of the polishing medium M circulating and flowing inside the polishing tank 20 is set to C, the polishing medium M has a speed distribution in which a flow speed decreases toward the flow center C. Therefore, in one embodiment, the polishing jig 1 may be supported such that the lowermost portion Z of the polishing jig 1 is disposed below the flow center C as indicated by a position Y of (B) of FIG. 4 to improve polishing efficiency of the workpiece W.

As described above, in the sectional view along the plane orthogonal to the rotation axis RA and passing through the center of the bottom surface 20*a*, the surface of the polishing medium M is represented as a straight line. Thus, as illustrated in (B) of FIG. 4, a height of the surface of the polishing medium M at a center of the polishing tank 20 in the width direction with respect to the bottom surface 20*a* is denoted by (H1+H2)/2. Since a height position of the flow center C of the polishing medium M is ½ of the height of the surface of the polishing medium M at the center of the polishing tank 20 in the width direction with respect to the bottom surface 20*a*, a height of the flow center C with respect to the bottom surface 20*a* is denoted by (H1+H2)/4.

That is, in the vibration barrel polishing method of the embodiment, the polishing jig 1 may be supported by the positioning unit 32 at a position at which the clearance d in the height direction between the lowermost portion Z of the polishing jig 1 and the bottom surface 20*a* of the polishing tank 20 is less than or equal to (H1+H2)/4. When the polishing jig 1 is supported and rotated at such a position, the polishing medium M collides with the workpiece W at a high speed. Thus, it is possible to improve polishing efficiency of the workpiece W.

In addition, the flow center C of the polishing medium M may be approximated as an intermediate point between a position b at the time when the polishing medium M is in a stationary state and the bottom surface 20*a* of the polishing tank 20. That is, the clearance d may be set to be less than or equal to ½ of a distance between the position b at the time when the polishing medium M is in the stationary state and the bottom surface 20*a* of the polishing tank 20.

In a vibration barrel polishing method, when a large workpiece is polished, it is common to perform polishing in a state in which the polishing medium is charge into the polishing tank up to the same depth as a contour shape of the workpiece. In contrast, in the vibration barrel polishing method of the present embodiment, since the workpiece W is polished by rotating the polishing jig 1 at a position at which the workpiece W may be efficiently polished in the polishing tank 20, the amount of the polishing medium M may be greatly reduced when compared to the amount used for normal vibration barrel polishing.

To smoothly rotate the polishing jig 1, it is preferable to fix the polishing jig 1 to the rotating shaft 31*c* such that the center of gravity at the time of attaching the workpiece W corresponds to a rotation center of the polishing jig 1.

Effect of Embodiment

According to the vibration barrel polishing method and the vibration barrel polishing system 50 of the present embodiment, since the polishing jig 1 is supported at a position at which the clearance d from the bottom surface 20*a* of the polishing tank 20 is greater than or equal to the grain diameter of the polishing medium M, the polishing medium M is inhibited from being ground between the polishing jig 1 and the bottom surface 20*a* of the polishing tank 20. In this way, the ground polishing medium M may be inhibited from entering the gap between the polishing jig 1 and the workpiece W, and thus it is possible to inhibit the workpiece W from being damaged or a polishing defect from occurring.

In addition, polishing efficiency of the workpiece W may be improved by holding the workpiece W in a region in which the polishing force by the polishing medium M is large.

Further, in the vibration barrel polishing method of the present embodiment, polishing efficiency of the workpiece W may be further improved since the relative speed between the polishing medium M and the workpiece W may be increased by performing vibration barrel polishing of the workpiece W while rotating the polishing jig 1 around the rotation axis RA.

In addition, in a conventional art, relative motion of the polishing medium M with respect to the workpiece W is determined based on a frequency of the polishing tank 20. However, according to the present embodiment, efficient polishing is allowed since the rotation speed may be appropriately selected.

Even though the embodiment has been described above, various modifications can be made without being limited to the above-described embodiment.

For example, even though an example of polishing the disc-shaped workpiece W has been described in the above embodiment, the shape of the workpiece W is not limited to the disc shape, and a flat-shaped workpiece W may be polished. Here, the flat-shaped workpiece refers to a workpiece having a larger width or a diameter than a thickness such as a plate shape, a ring shape, a frame shape, a cylindrical shape having a larger diameter than a height, etc. For example, the shape of the polishing jig 1 may be set to a shape having a small number of protrusions such as a cylindrical shape which does not inhibit a smooth flow of the polishing medium M.

In addition, the vibration barrel polishing method of the embodiment may be applied to polishing of a large workpiece W having a high weight. Here, for example, the large workpiece W having the high weight refers to a workpiece having a diameter of 400 mm or more or a workpiece W having a weight such that the polishing medium M is crushed by the weight of the workpiece W when the workpiece W is self-standing and rolled inside the polishing tank 20. Examples of such a workpiece W include a bearing retainer, a wheel such as a gear, a railroad, etc., a pulley, an integrated rotor blade, etc.

In addition, in the above embodiment, the position of the flow center C of the polishing medium is determined based on the maximum height H1 and the minimum height H2 of the surface of the polishing medium M with respect to the bottom surface 20*a*. However, the flow center C may be set based on the position of the center of gravity of the polishing medium M, or the flow center C may be set based on a height position at which upper and lower areas are equal to each other when the polishing medium M is divided by a horizontal straight line in the sectional view illustrated in (A) of FIG. 4.

Furthermore, in the above embodiment, the polishing jig 1 is rotated in the same direction as the flow direction of the polishing medium M. However, the rotation direction of the polishing jig 1 is not limited to the same direction as the flow direction of the polishing medium M. For example, the workpiece W may be polished by alternately switching the rotation direction of the polishing jig 1 between the same direction as the flow direction of the polishing medium M and an opposite direction thereof. When the rotation direction of the polishing jig 1 is alternately switching in this way, it is possible to further improve the polishing uniformity of the workpiece W and to improve a polishing rate. Instead of alternately switching the rotation direction of the polishing jig 1, a direction of a rotational vibration of the polishing tank 20 may be switched by alternately switching a rotation direction of the rotating shaft 25.

In addition, in the above embodiment, the position of the rotating shaft 31*c* is constant. However, it is possible to cause the polishing jig 1 to make a planetary motion by rotating the rotating shaft 31*c* around another axis.

In addition, a physical limiter may be provided as another mode of a mechanism for controlling a position at which the polishing jig 1 is supported in the positioning unit 32. For example, as illustrated in FIG. 5, a frame 36 to which a contact bolt 36*a* is attached may be provided below the frame 31*a* of the rotating unit 31. The contact bolt 36*a* may adjust a position in the height direction from the frame 36. Since an upper end of the contact bolt 36*a* serves as the descending end of the rotating unit 31, the polishing jig 1 may be held at a predetermined height position such that the clearance d between the lowermost portion Z of the polishing jig 1 and the bottom surface 20*a* of the polishing tank 20 falls within the above-described range.

Furthermore, in the vibration barrel polishing method of the above-described embodiment, a step of supporting the polishing jig 1 in a state in which the lowermost portion Z of the polishing jig 1 is separated from the bottom surface 20*a*, a step of causing the polishing medium M to flow in the polishing tank 20, and a step of rotating the polishing jig 1 around the rotation axis RA are performed in order.

However, these steps may be performed in an arbitrary order. For example, the same effect as that of the above embodiment may be obtained when the step of causing the polishing medium M to flow in the polishing tank 20 is performed after the step of supporting the polishing jig 1 in the state in which the lowermost portion Z of the polishing jig 1 is separated from the bottom surface 20*a* and the steps of rotating the polishing jig 1 around the rotation axis RA.

Example

Hereinafter, a description will be given of an example of the vibration barrel polishing method according to the invention. The invention is not limited to the example.

In the present example, a polishing jig having the same schematic shape as that of FIG. 1 was used as the polishing jig 1. The outer diameters of the first guard member 10 and the second guard member 11 were set to 840 mm, and the width of the polishing jig 1 was set to 213 mm (¼ or more of the outer diameter). The width of the masking member 13 is 50 mm, which is 5/4 times the width of the workpiece W described below. Referring to dimensions of the window portion 11*w*, a length in a center direction was set to 210 mm, and a length in a circumferential direction was set to 480 mm.

The workpiece W of this example was a titanium disc having a diameter of 800 mm and a thickness of 40 mm. A sintered medium (manufactured by SINTOKOGIO, LTD.) having an oblique triangular prism having a side of 4 mm and a length of 4 mm was selected as the polishing medium M, and charge into the polishing tank to have a volume of ⅓. In addition, a VF-1423W type manufactured by SINTOKOGIO, LTD. was modified such that the dimensions of the polishing tank 20 were set to the width 800 mm×the length 1,000 mm×the height 800 mm, and a partition plate was installed in the central portion was used as the vibration barrel polishing apparatus 2. In addition, a compound (manufactured by SINTOKOGIO, LTD., GLM-4) added to tap water by 0.5% was used as a polishing liquid. The supply amount of the polishing liquid was 400 ml/min.

Here, the height of the liquid surface of the polishing medium M with respect to the bottom surface 20*a* at the time of polishing was H1: 710 mm, H2: 330 mm, and the height of the flow center C with respect to the bottom surface 20*a* was C: 260 mm.

In addition, polishing was performed by changing the clearance d between the lowermost portion Z of the polishing jig 1 and the bottom surface 20*a* to 50 min and 290 mm (comparative example).

Evaluation was carried out with regard to the following items.

(1) Presence or absence of grinding of media (2) Polishing degree (workpiece finish)

(3) Polishing time (1) Presence or Absence of Grinding of Media

After completion of the polishing, the entire amount of the polishing medium M was collected, and a pulverized material of the polishing medium. M was confirmed using a sieve having an opening of 1 mm. In addition, when the workpiece W was detached from the polishing jig 1 after polishing was completed, it was verified whether the ground polishing medium M entered between the outer peripheral surface Wa of the workpiece W and the masking member 13. In the present example, since the pulverized material of the polishing medium M was not found, it was confirmed that the polishing medium M was not ground between the polishing jig 1 and the bottom surface 20*a* of the polishing tank 20 in the polishing method of the present example.

(2) Evaluation of Polishing Degree

In the workpiece before and after polishing, three arbitrary positions on one surface and a back surface thereof of a polished portion were selected, and surface roughness Ra specified in JIS B 6001 (1994) was measured using a surface roughness measuring device (manufactured by TOKYO SEIMITSU CO., LTD.: SURFCOM 130A). Progress of polishing and unevenness of polishing were evaluated by comparing these measured values.

Average values of the surface roughness Ra of the workpiece before polishing were 0.88 μm (one surface) and 0.69 μm (back surface). In addition, the variation with respect to these average values was 13% at maximum.

When the clearance d was set to 50 mm, the average values of the surface roughness Ra of the workpiece after polishing for 6 hours were 0.19 μm (one surface) and 0.20 μm (back surface). In addition, the variation with respect to these average values was 6% at the maximum.

Meanwhile, when the clearance d was set to 290 mm, the average values of the surface roughness Ra of the workpiece after polishing for 6 hours were 0.25 μm (one surface) and 0.54 μm (back surface), and there was a big difference in the progress of polishing between the one surface and the back surface. In addition, the variation with respect to these average values was 11% at the maximum.

From this result, it was continued that polishing unevenness is small and polishing may be satisfactorily performed in the polishing method of the present example.

(3) Polishing Time

When the clearance d was set to 290 mm, the average value of the surface roughness Ra of one surface of the workpiece after polishing for 9 hours was 0.20 vim. When the clearance d was set to 50 mm, the same surface roughness as that in the case in which polishing was performed for 6 hours was obtained. However, the average value of the surface roughness Ra of the back surface was 0.48 μm, and the same surface roughness as that in the case in which the clearance d was set to 50 mm and polishing was performed for 6 hours was not obtained. From this result, it was confirmed that the polishing time was shortened in the polishing method of the example.

For comparison, polishing was performed in a state in which the polishing jig 1 was self-standing on the bottom surface 20*a* of the polishing tank 20 without using the support apparatus 30. In this case, a polishing time of 8 hours was required to obtain approximately the same surface roughness as the above-mentioned surface roughness Ra when the clearance d was set to 50 mm. In addition, it was confirmed that when the workpiece W was detached from the polishing jig 1 after polishing was finished, the ground workpiece W entered between the outer peripheral surface Wa of the workpiece W and the masking member 13.

Therefore, it was confirmed that the polishing time was reduced by about 20% by the polishing method of the present example, and there was no concern about the workpiece being damaged by the ground polishing medium M.

As described above, it was confirmed that (1) since the polishing medium is not ground between the polishing jig 1 and the bottom surface 20*a* of the polishing tank 20, it is possible to prevent the workpiece from being damaged or a polishing defect due to grinding of the polishing medium, (2) there is no polishing unevenness and polishing may be satisfactorily performed, and (3) the polishing time may be reduced, when the polishing method of the present example is used.

REFERENCE SIGNS LIST

1 . . . polishing jig, 2 . . . vibration barrel polishing apparatus, 10 . . . first guard member, 10*w* . . . window portion, 11 . . . second guard member, 11*w* . . . window portion, 12 . . . fixing member, 13 . . . masking member, 14 . . . attachment member, 20 . . . polishing tank, 20*a* . . . bottom surface, 21 . . . spring, 22 . . . pedestal, 23 . . . bearing, 24 . . . counterweight, 25 . . . rotating shaft, 26 . . . coupler, 27 . . . motor, 30 . . . support apparatus, 31 . . . rotating unit, 32 . . . positioning unit, C . . . flow center, M . . . polishing medium, S . . . virtual curved surface, W . . . workpiece, Z . . . lowermost portion.

The invention claimed is:

1. A vibration barrel polishing method using a vibration barrel polishing system that includes a polishing tank having a bottom surface therein and a polishing jig capable of holding a workpiece and rotatable around a rotation axis, the vibration barrel polishing method comprising steps of:

supporting the polishing jig in the polishing tank in a state in which a lowermost portion of the polishing jig is separated from the bottom surface by a clearance d;

causing the polishing medium to flow in the polishing tank; and rotating the polishing jig around the rotation axis in the state in which the lowermost portion of the polishing jig is separated from the bottom surface by the clearance d and an uppermost portion of the polishing jig is disposed above a surface of the polishing medium, wherein the clearance d is equal to or greater than a grain diameter of the polishing medium and equal to or smaller than (H1+H2)/4, wherein H1 represents a maximum height of the surface of the polishing medium flowing in the polishing tank with respect to the bottom surface and H2 represents a minimum height thereof in a cross-sectional view along a plane orthogonal to the rotation axis and passing through a center of the bottom surface.

2. The vibration barrel polishing method according to claim 1, wherein the workpiece has a flat shape.

3. The vibration barrel polishing method according to claim 2, wherein the polishing jig includes a first guard member and a second guard member disposed to face each other through an accommodation space, a contour shape of the first guard member and the second guard member having a disc shape larger than the workpiece, and a fixing member configured to fix the workpiece in the accommodation space such that the entire workpiece is located inside the accommodation space, a window portion communicating with the accommodation space is formed in each of the first guard member and the second guard member, and the polishing medium is allowed to pass between an inside and an outside of the accommodation space through the window portion and an opening between an outer edge of the first guard member and an outer edge of the second guard member.

4. The vibration barrel polishing method according to claim 1, wherein the polishing medium is caused to flow to draw an arc-shaped trajectory inside the polishing tank in the step of causing the polishing medium to flow in the polishing tank, and the polishing jig is rotated in the same direction as a flow direction of the polishing medium in the step of rotating the polishing jig around the rotation axis.

5. The vibration barrel polishing method according to claim 1, wherein the polishing medium is caused to flow to draw an arc-shaped trajectory inside the polishing tank in the step of causing the polishing medium to flow in the polishing tank, and the step of rotating the polishing jig around the rotation axis includes a step of rotating the polishing jig in the same direction as a flow direction of the polishing medium and a step of rotating the polishing jig in an opposite direction of the flow direction of the polishing medium.

6. The vibration barrel polishing method according to claim 2, wherein the polishing medium is caused to flow to draw an arc-shaped trajectory inside the polishing tank in the step of causing the polishing medium to flow in the polishing tank, and the polishing jig is rotated in the same direction as a flow direction of the polishing medium in the step of rotating the polishing jig around the rotation axis.

7. The vibration barrel polishing method according to claim 3, wherein the polishing medium is caused to flow to draw an arc-shaped trajectory inside the polishing tank in the step of causing the polishing medium to flow in the polishing tank, and the polishing jig is rotated in the same direction as a flow direction of the polishing medium in the step of rotating the polishing jig around the rotation axis.

8. The vibration barrel polishing method according to claim 2, wherein the polishing medium is caused to flow to draw an arc-shaped trajectory inside the polishing tank in the step of causing the polishing medium to flow in the polishing tank, and the step of rotating the polishing jig around the rotation axis includes a step of rotating the polishing jig in the same direction as a flow direction of the polishing medium and a step of rotating the polishing jig in an opposite direction of the flow direction of the polishing medium.

9. The vibration barrel polishing method according to claim 3, wherein the polishing medium is caused to flow to draw an arc-shaped trajectory inside the polishing tank in the step of causing the polishing medium to flow in the polishing tank, and the step of rotating the polishing jig around the rotation axis includes a step of rotating the polishing jig in the same direction as a flow direction of the polishing medium and a step of rotating the polishing jig in an opposite direction of the flow direction of the polishing medium.

10. The vibration barrel polishing method according to claim 1, wherein the vibration barrel polishing system further comprising:

a positioning unit configured to change a position of the polishing jig in a height direction;

a rotating unit configured to rotate the polishing jig around the rotation axis; and a moving unit configured to move the positioning unit and the rotating unit along a horizontal direction, and the vibration barrel polishing method further comprising moving the positioning unit and the rotating unit in the horizontal direction by the moving portion so that the polishing jig is disposed above the polishing tank.

11. A vibration barrel polishing system comprising:

a polishing tank having a bottom surface;

a rotating shaft configured to rotate about an axis to vibrate the polishing tank;

a polishing jig configured to hold a workpiece;

a positioning unit configured to support the polishing jig in the polishing tank, the positioning unit being capable of changing a position of the polishing jig in a height direction;

a rotating unit configured to rotate the polishing jig around a rotation axis; and a controller configured to control the rotating shaft, the positioning unit and the rotating unit, wherein the controller is configured to:

control the positioning unit so that the polishing jig is disposed at a position where a lowermost portion of the polishing jig is separated from the bottom surface by a clearance d;

rotate the rotating shaft so that a polishing medium flows in the polishing tank by vibration of the polishing tank; and control the rotating unit to rotate the polishing jig in a state in which a lowermost portion of the polishing jig is separated from the bottom surface by the clearance d and an uppermost portion of the polishing jig is disposed above a surface of the polishing medium, and wherein the clearance d is equal to or greater than a grain diameter of the polishing medium and equal to or smaller than (H1+H2)/4, wherein H1 represents a maximum height of the surface of the polishing medium flowing in the polishing tank with respect to the bottom surface and H2 represents a minimum height thereof in a cross-sectional view along a plane orthogonal to the rotation axis and passing through a center of the bottom surface.

12. The vibration barrel polishing system according to claim 11, further comprising:

a moving unit configured to move the polishing jig along a horizontal direction, wherein the positioning unit, the rotating unit, and the moving unit are integrally provided.

* * * * *